United States Patent [19]

Barr

[11] Patent Number: 4,898,252

[45] Date of Patent: Feb. 6, 1990

[54] CUTTING STRUCTURES FOR ROTARY DRILL BITS

[75] Inventor: John D. Barr, Cheltenham, England

[73] Assignee: Reed Tool Company Limited, Gloucestershire, England

[21] Appl. No.: 269,780

[22] Filed: Nov. 10, 1988

[30] Foreign Application Priority Data

Nov. 12, 1987 [GB] United Kingdom ..... 8726541

[51] Int. Cl.[4] ..... E21B 10/56

[52] U.S. Cl. ..... 175/379; 175/410

[58] Field of Search ..... 175/379, 409, 410, 412; 51/295; 76/108 R, 108 A, DIG. 12; 408/144, 145

[56] References Cited

U.S. PATENT DOCUMENTS

| | | | |
|---|---|---|---|
| 2,203,747 | 6/1940 | Sandstone | 175/379 |
| 2,833,520 | 5/1958 | Owen | 175/379 |
| 2,846,193 | 8/1958 | Chadderon | 175/379 |
| 4,128,136 | 12/1978 | Generoux | 175/379 |
| 4,324,300 | 4/1982 | Logan, Jr. | 175/379 |
| 4,719,979 | 1/1988 | Jones | 175/410 |

FOREIGN PATENT DOCUMENTS

| | | | |
|---|---|---|---|
| 0754037 | 8/1980 | U.S.S.R. | 175/379 |

*Primary Examiner*—Bruce M. Kisliuk

*Attorney, Agent, or Firm*—Browning, Bushman, Zamecki & Anderson

[57] ABSTRACT

A cutting structure for a rotary drill bit includes a cutting element 30 having a front layer 32 formed of polycrystalline diamond, bonded to a backing layer 33 formed of tungsten carbide. The cutting element is bonded to a carrier 33 which is formed of a number of detachable individual elements having means holding them in position such that, upon wear of the cutting structure in use, the holding means of an element engaging the formation will eventually fail, causing detachment of that element from the carrier, and thereby reducing the area of the cutting structure in contact with the formation.

20 Claims, 4 Drawing Sheets

CUTTING STRUCTURES FOR ROTARY DRILL BITS

BACKGROUND OF THE INVENTION

The invention relates to rotary drill bits for use in drilling or coring deep holes in subsurface formations and, in particular, to a form of cutting structure for use on such bits.

Rotary drill bits of the kind to which the invention relates comprise a bit body having a shank, inner passages for supplying drilling fluid to the face of the bit, and a plurality of cutting structures mounted on the face of the bit.

Each cutting structure includes a front layer formed of superhard material and having a front cutting face defining a cutting edge, and a backing structure formed of less hard material. For example, the superhard material may be polycrystalline diamond and the backing structure may be formed of cemented tungsten carbide.

The backing structure may include a backing layer or less hard material to which the front layer is bonded. The backing layer may then constitute the while of the backing structure, or the backing structure may further include a carrier on which the cutting element (comprising the front layer and backing layer) is mounted, for example by bonding.

Cutting elements are also available in the form of a unitary layer of polycrystalline diamond, such unitary cutting elements having the advantage that they may be thermally stable at the temperatures used to form some types of bit body. In this case there is no backing layer and the carrier on which the cutting element is mounted will constitute the whole of the backing structure.

Where a carrier is provided, the cutting element is usually bonded, for example by brazing, to the carrier which may be in the form of a stud of tungsten carbide which is received and located in a socket in the bit body. The bit body may be machined from steel or may comprise an infiltrated matrix material formed by a powder metallurgy process. The construction of the bit body and the method of mounting the cutting structures thereon do not form part of the present invention and will not therefore be described in detail.

The two or three layer arrangement of the cutting structure provides a degree of self-sharpening since, in use, the less hard material of the carrier and/or backing layer wears away more easily than the harder cutting face of the cutting element.

However, although this self-sharpening effect is advantageous, a wear flat forms on the cutting structure in the course of its use, and the necessary configuration of the cutting structure is usually such that the wear flat increases in area with continuing use, thus resulting in increasing frictional resistance to the rotation of the drill bit and increasing heat effect, which may lead to failure of a cutting element or its bond to a carrier or bit body.

The present invention sets out to provide an arrangement whereby, as the cutting structure wears in use, the configuration of the structure changes so that the wear flat does not continually increase in area but periodically becomes reduced in area.

SUMMARY OF THE INVENTION

According to the invention there is provided a cutting structure for a rotary drill bit, including a front layer formed of superhard material and having a front cutting face defining a cutting edge, and a backing structure formed of less hard material, and at least a portion of the backing structure rearwardly of the cutting edge of the front layer being formed of a number of individual elements having means holding them in position such that, upon wear of the cutting edge and backing structure in use, the holding means of an element engaging the formation will eventually fail, causing detachment of that element from the backing structure, and thereby reducing the area of the backing structure in contact with the formation.

Thus, as wear of the backing structure occurs, instead of it being gradually and continuously eroded away, the individual elements of the backing structure will become detached and removed at intervals. The removal of an element immediately reduces the area of the backing structure which is engaging the formation. This area then gradually increases again as further wear takes place until a further element becomes detached whereupon the area of the wear flat is again reduced. This process can be repeated depending on the number of detachable elements and the extent of wear to be permitted before the drill bit must be replaced.

The failure of the means holding the elements in position may be as a result of weakening of the holding means due to wear and/or of increase in temperature, or due to the wear causing an increase in the forces applied to the holding means.

The individual elements of the backing structure may comprise separately formed elements bonded together by a bonding agent, for example a bonding alloy infiltrated between the elements. In this case the strength of the bond on an element for the time being engaging the formation may be weakened as a result of the high temperature to which it is subjected, and/or the tendency of the bond to fail may be increased by the increase in forces applied to the bond.

Instead of the individual elements being separately formed, they may comprise part of a single integral body of material, each element being joined to the rest of the body by a zone of weakness which constitutes at least part of the holding means of that element. For example, the integral body of material may comprise a solid body formed with slots or cuts to define the individual elements, the slots or cuts extending only partly through the body of material. The slots or cuts between the individual elements may also be filled with a bonding agent such as an infiltrated binder alloy. Alternatively, it may be preferably for the slots or cuts to be filled with a non-bonding material, such as mica or a refractory non-wetting material.

Preferably said individual elements of the backing structure are elongate in a direction away from the front face of the cutting structure. For example, each element may be in the form of an elongate bar, rod or plate.

The elongate elements may extend substantially at right angles to the front cutting face of the cutting structure or may extend at such an angle thereto that, in use, the elements extend at a shallower angle to the formation being cut when, as is usual, the cutting of the cutting element is disposed at a negative back rake angle.

The backing structure may be entirely composed of said individual elements, or it may comprise a solid body in addition to said elements. For example, in the case where the cutting structure comprises a cutting element and a carrier, the carrier may include a solid body spaced rearwardly of the cutting element, the said individual elements being disposed between the solid body and the cutting element.

In an alternative arrangement the cutting elements may be mechanically held by portions of the carrier and/or cutting element which wear away in use of the cutting structure, so that detachment of the elements is permitted by physical removal, due to wear, of the holding portions.

Although it is desirable to provide a plurality of detachable elements in the backing structure, it will be appreciated that some advantages may be given by providing only a single detachable element. For example, the single detachable element may be so configured that upon its removal as a result of wear the configuration of the part of the cutting structure which is acting on the formation is substantially restored to a configuration similar to its initial configuration.

DETAILED DESCRIPTION OF THE PREFERRED EMBODIMENTS

Figure 1:
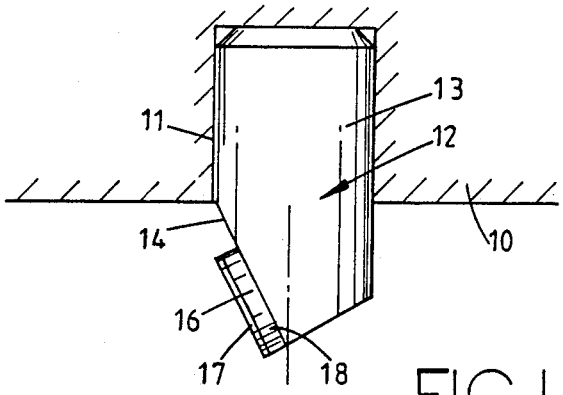
FIG. 1. (PRIOR ART)
FIG. 1 is a section through a portion of a bit body showing a typical prior are cutting structure.

Referring to FIG. 1, which shows a typical prior art cutting structure for a rotary drill bit, the bit body is indicated at 10 and, as is well known, may be formed from steel or solid infiltrated matrix material. The general arrangement of such drill bits is well known and will not therefore be described in detail. The bit body is formed over the surfce thereof with a plurality of cylindrical sockets 11, usually of circular cross-section, and received in each socket is a cutting structure 12.

The cutting structure comprises a carrier in the form of a generally cylindrical stud 13, formed for example from tungsten carbide, which is formed adjacent one end thereof with an inclined plane surface 14 which is disposed at an angle of less than 90° to the longitudinal axis of the stud.

Bonded on to the inclined surface 14 is a preform cutting element 16 comprising a cutting layer 17 of polycrystalline diamond bonded to a thicker backing layer 18 of tungsten carbide. The cutting element 16 is in the form of a circular disc. The stud 13 may be shrink-fitted and/or brazed into the socket 11.

In a cutting structure of this kind, the backing layer 18 of the cutting element and the stud 13 together make up the aforementioned backing structure for the cutting layer 17.

Figure 2:
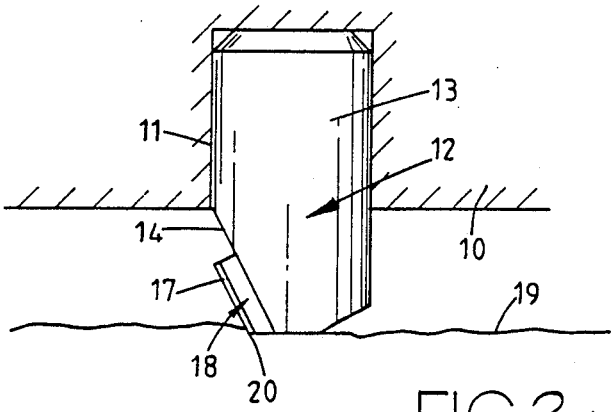
FIG. 2. (PRIOR ART)
FIG. 2 is a similar view to FIG. 1 showing the cutting structure after wear has occurred in use.

FIG. 2 shows the cutting structure of FIG. 1 after the drill bit has been in use for some time and wear of the structure has taken place. The formation on which the cutting structure is acting is indicated at 19. It will be seen that a wear flat has been formed across the diamond layer 17, backing layer 18 and stud 13. However, since the backing layer 18 and stud 13 are formed from material which is less hard than the diamond layer 17 these parts have worn to a slightly greater extent than the diamond layer with the result that a step, indicated at 20, has been formed between the diamond layer 17, and backing layer 18. it will thus be seen that a self-sharpening effect is provided.

Figure 3:
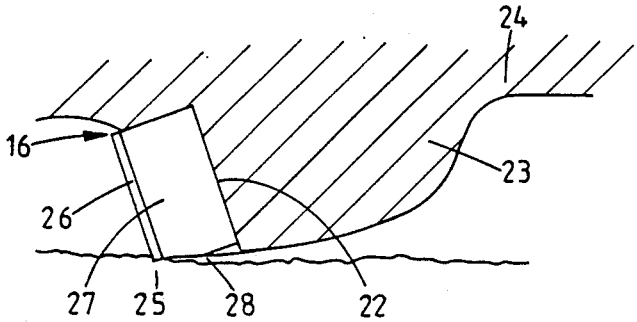
FIG. 3. (PRIOR ART)
FIG. 3 is a section through an alternative prior art cutting structure, after wear has occurred.

FIG. 3 shows an alternative known form of cutting structure comprising a front cutting layer 26 of polycrystalline diamond bonded to a thicker cylindrical backing layer 27 of tungsten carbide. In this case, a separate carrier is not provided, and the backing layer 27 constitutes the entire backing structure. The cutting structure is received in a socket 22 formed in an upstanding blade 23 on the bit body 24. Here, again, a step 25 is formed, after wear has occurred, between the diamond layer 26 and the backing layer 27. In this case, however, since the material of the blade 23 will normally be less hard than the material of the backing layer 27 (for example being formed of infiltrated matrix material) there may also be a further step as indicated at 28 between the material of the backing layer and the blade material.

Although two-layer cutting elements are commonly used to provide this self-sharpening feature, cutting elements are also known which comprise a single unitary layer of polycrystalline diamond material and in this case the self-sharpening effect is provided by the formation of a step, after wear has occurred, between the rear surface of the cutting element and the carrier on which it is mounted, or between the element and the body of the drill bit in the case where the cutting element is mounted directly on the body.

In each of the prior art arrangements described it will be seen that the total area of the wear flat will increase progressively as wear increases. The steps between the different parts of the structures are very small so that in practice the whole area of the wear flat is rubbing on the formation. This provides substantial frictional resistance to the rotation of the drill bit with the result that greater driving torque is required as the bit becomes worn. Furthermore, the increase in the rubbing area generates increasing heat with the risk of diamond degradation and failure of the components of the cutting assembly or of the bonds between them.

Figure 4:
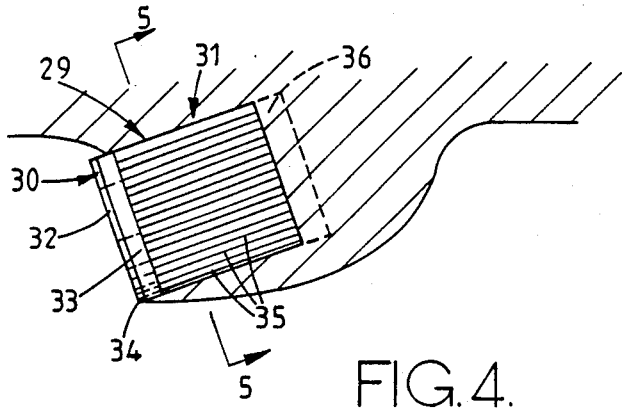
FIG. 4 is a section through a portion of a bit body showing a cutting structure according to the invention.

FIG. 4 shows an arrangement in accordance with the invention. The cutting structure 29 is generally similar in configuration to the prior art arrangement of FIG. 3 and comprises a cutting element 30 bonded to a carrier 31. The cutting element comprises a front cutting layer 32 of polycrystalline diamond bonded to a backing layer 33, for example of tungsten carbide. The cutting edge of the cutting element is indicated at 34.

Figure 5:
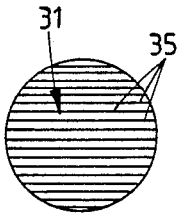
FIG. 5 is a section along the line 5—5 of FIG. 4, FIGS. 6 to 9 are sections through alternative forms of cutting structure according to the invention.

The carrier 31 to which the cutting element 30 is bonded comprises several layers of flat plates 35 (see also FIG. 5). The plates makes up the cylindrical shape of the carrier 31. The individual plates are bonded together by a solder, braze or other suitable bonding agent.

In use of the drill bit, a wear flat is first formed on the cutting element 30 adjacent the cutting edge 34. As wear increases the wear flat will eventually reach the lowermost plate 35 of the carrier 31. As this plate rubs on the formation two effects occur. Firstly the lowermost plate is subjected to forces which impose increasing plate is subjected to forces which impose increasing stresses on the bond holding the plate in position on the carrier. At the same time the increase in temperature in the lower part of the carrier, due to the lowermost plate rubbing on the formation, will have the effect of weakening the bond. The combination of these two effects will eventually result in the bond breaking down and the lowermost plate becoming detached from the carrier and being carried away with the rest of the drilling debris, entrained in the drilling mud. The sudden removal of the lowermost plate of the carrier has the effect of instantly increasing the clearance to the rear of the cutting edge 34 and reducing the size of the wear flat, thus reducing the resistance to drilling and reducing the temperature rise. The process is then repeated successively on the plates 35, so that as the cutting structure wears plates become successively detached from the structure. Thus, during the life of the cutting structure, the wear flat engaging the formation does not steadily increase, as is the case with the prior art structures, but is intermittently reduced as the elements forming the carrier are successively removed.

In the arrangement of FIGS. 4 and 5, the end of the carrier 31 remote from the cutting element 30 may be formed by a solid disc of tungsten carbide or other hard material as indicated in dotted lines at 36, the plates 35 then being sandwiched between the disc 36 and the cutting element 30.

The plates 35 may be individually formed and assembled into the cylindrical shape of the carrier. Alternatively, the carrier may be preformed as a solid cylindrical shape and then cut into individual plates, for example by a spark cutting process.

Figure 6:
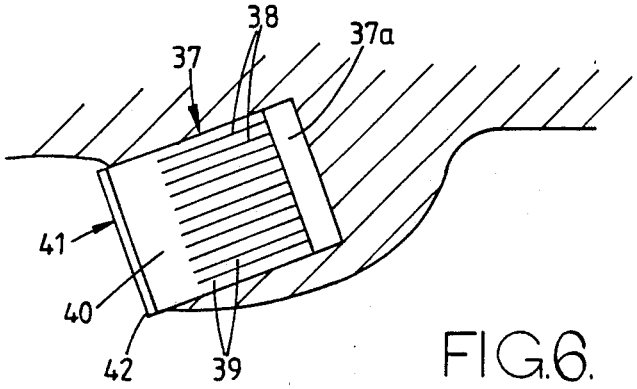

In the alternative arrangement shown in FIG. 6, the front diamond layer 41 is bonded to a thick cylindrical backing layer 37 of tungsten carbide. Parallel slots 38 are cut into the backing layer 37 from one end, formng plates 39. The slots 38 do not extend for the whole length of the backing layer but stop short of one end to leave a solid portion 40 adjacent the diamond layer 41. A disc **37*a* of solid tungsten carbide may abut the end of the backing layer 37, as shown. in this arrangement each plate 39 is likely to be retained in the backing layer 37 until the wear on the backing layer rearwardly of the cutting edge 42 has been sufficient to break through or weaken the solid connection between each plate 39 and the portion 40**.

Figure 7:
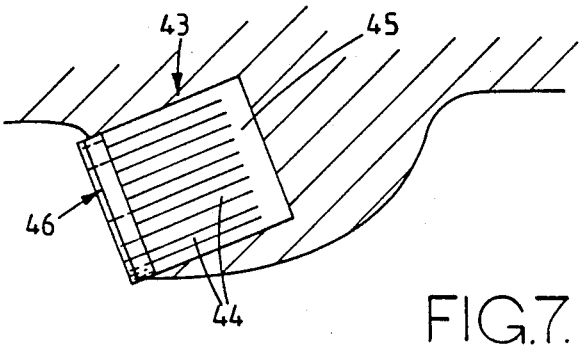

FIG. 7 shows an alternative arrangement where a carrier 43 for a cutting element 46 is partly slotted to form plates 44 but in this case a solid portion 45 is disposed at the end of the carrier remote from the cutting element 46. In this case the lowermost plate 44 will become detached when the stresses thereon are sufficient to break the plate away from the solid portion 45.

Figure 8:
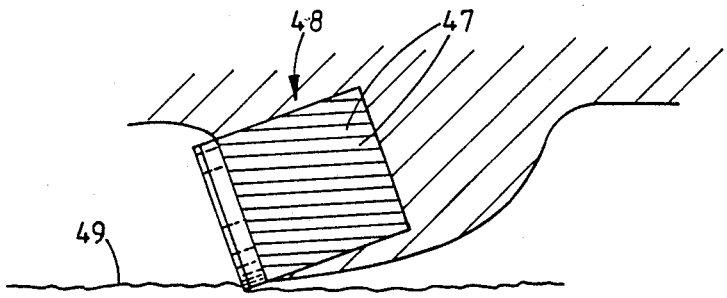

In the above arrangements the plates 35, 39 and 44 extend away from the cutting element in a direction generally parallel to the axis of the cutting structure. FIG. 8 shows an arrangement where the plates 47 extend at a non-perpendicular angle to the axis of the carrier 48, and the cutting structure is oriented in the bit so that the plates are at a shallower angle to the formation 49.

Figure 9:
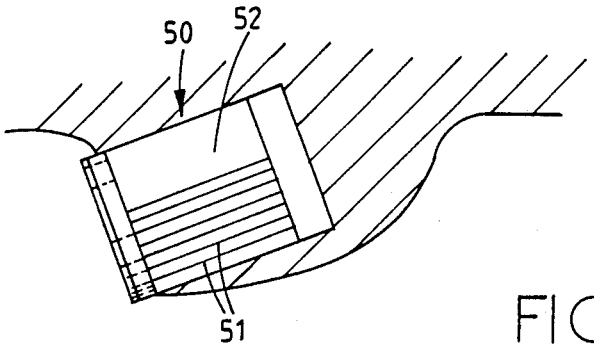

A drill bit normally ends it useful working life before the cutting structure has been completely worn away and there may therefore be no advantage in forming from separate elements that part of the backing structure which would not, in use, be subjected to wear. As shown in FIG. 9, therefore, the carrier 50 may comprise individual plates 51 in its lower portion and a solid part 52 in its upper portion.

Figure 10:
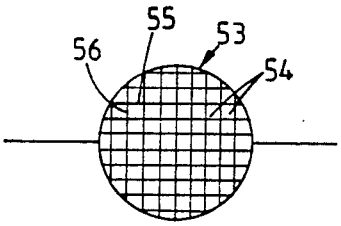
FIG. 10 is a cross section through a cutting structure according to the invention.

In the above described arrangements, the individual elements making up the carrier or backing layer have been described as plates. However, the elements might also be in the form of elongate rods or bars as shown in FIG. 10, which is a diagrammatic cross-section through a carrier or backing layer 53. In this case the elements 54 making up the carrier or backing layer are of rectangular section and are formed by cutting the initially solid material of the carrier or backing layer by two sets of slots 55 and 56 at right angles to one another.

Figure 11:
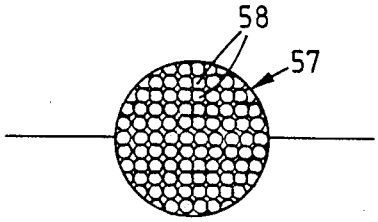
FIG. 11 is a cross section through an alternative form of cutting structure.

In the alternative construction shown in FIG. 11 a carrier 57, instead of being formed from an initially solid stud, is assembled from a plurality of cylindrical circular section rods 58 which are bonded together.

Figure 12:
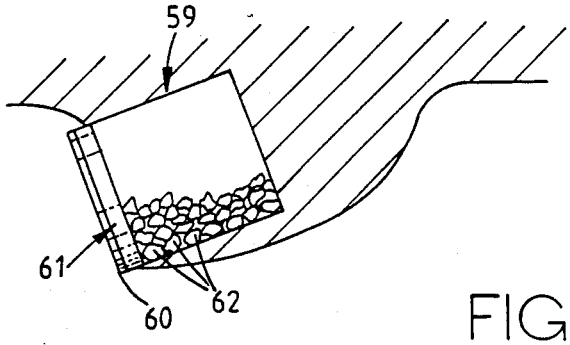
FIG. 12 is a section through a portion of a bit body showing a further cutting structure according to the invention.

FIG. 12 shows diagrammatically an alternative construction in which the carrier 59, or at least the part thereof rearwardly adjacent the cutting edge 60 of the cutting element 61, is formed from comparatively large grains 62 of hard material bonded together. In this arrangement, as wear occurs whole grains 62 become detached and removed in succession so as to provide a continuing substantial clearance of the carrier to the rear of the cutting edge 60.

Figure 13:
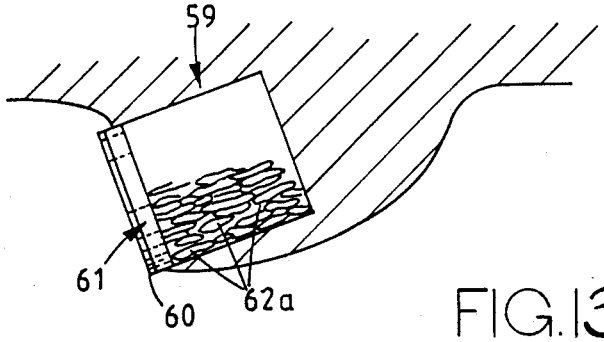
FIG. 13 is a similar view showing another form of cutting structure.

To provide a similar effect to the rod and plate structures described above, the granular structure of the carrier 59 is preferably such that the large whole grains are elongate, as indicated at **62*a* in the arrangement of FIG. 13**.

Figure 14:
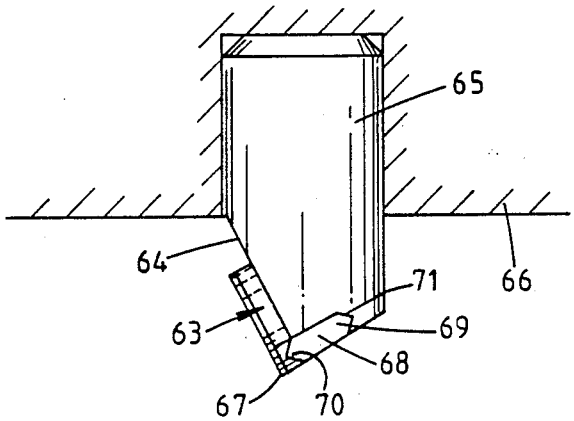
FIG. 14 is a similar view showing a still further form of cutting structure.

FIG. 14 shows an alternative construction where a cutting element 63 is mostly mounted on a surface 64 on a stud 65 received in the bit body 66. Rearwardly adjacent the cutting edge 67 there is provided a single element 68 which is mechanically coupled to the stud 65 and to the cutting element 63 itself.

This mechanical coupling is achieved by bevelled edges 69 and 70 on the element 68 being received in correspondingly shaped grooves 71 and 72 in the stud 65 and rear of the cutting element 63 respectively. The element 68 may also be bonded in position.

As the cutting element 63 wears in use, a point will be reached where the wear breaks the connection between the front end of the element 68 and the rear surface of the cutting element 63, whereupon the element 68 will become detached from the stud 65 providing once again substantial clearance behind the cutting edge of the cutting element.

I claim:

1. A preform type cutting structure for a drag type rotary well drill bit, including a front layer formed of superhard material and having a rear surface and a front cutting face defining a cutting edge at one extremity of the layer of superhard material, and a backing structure formed of less hard material than said front layer, and at least a portion of the backing structure rearwardly of the cutting edge of the front layer being formed of a number of individual elements arranged one after another progressing crossways along the layer of superhard material, in a direction away from said cutting edge, and having means holding them in position such that, upon wear of the cutting edge and backing structure in use, the holding means of an element closest to the cutting edge and engaging the formation will eventually fail, causing detachment of that element from the backing structure, and thereby reducing the area of the backing structure in contact with the formation.

2. A cutting structure according to claim 1, wherein the individual elements of the backing structure comprise separately formed elements bonded together by a bonding agent.

3. A cutting structure according to claim 2, wherein the bonding agent comprises a bonding alloy infiltrated between the elements.

4. A cutting structure according to claim 1, wherein the individual elements comprise part of a single integral body of material, each element being joined to the rest of the body by a zone of weakness which constitutes at least part of the holding means of that element.

5. A cutting structure according to claim 4, wherein the integral body of material comprises a solid body formed with slots to define the individual elements, the slots extending only partly through the body of material.

6. A cutting structure according to claim 5, wherein the slots between the individual elements are filled with a bonding agent.

7. A cutting structure according to claim 6, wherein the bonding agent is infiltrated binder alloy.

8. A cutting structure according to claim 5, wherein the slots are filled with a non-bonding material.

9. A cutting structure according to claim 8, wherein the non-bonding material is selected from mica or a refractory non-wetting material.

10. A cutting structure according to claim 1, wherein said individual elements of the backing structure are elongate in a direction away from the front face of the cutting structure.

11. A cutting structure according to claim 10, wherein each element of the backing structure is selected from an elongate bar, an elongate rod, or an elongate plate.

12. A cutting structure according to claim 11, wherein the elongate elements extend substantially at right angles to the front cutting face of the cutting strucure.

13. A cutting structure according to claim 11, wherein the elongate elements extend at a non-perpendicular angle to the front cutting face of the cutting structure.

14. A cutting structure according to claim 1, wherein the backing structure is entirely composed of said individual elements.

15. A cutting structure according to claim 1, wherein the backing structure comprises a solid body in addition to said elements.

16. A cutting structure according to claim 15, wherein the cutting structure comprises a cutting element and a carrier, and the carrier includes a solid body spaced rearwardly of the cutting element, the said individual elements being disposed between the solid body and the cutting element.

17. A cutting structure according to claim 1, wherein the cutting structure comprises a cutting element and a carrier and wherein the individual elements are mechanically held by portions of the carrier and/or cutting element which wear away in use of the cutting structure, so that detachment of the elements is permitted by physical removal, due to wear, of the holding portions.

18. A cutting structure according to claim 1, wherein there is provided only a single detachable element, said element being so configured that upon its removal as a result of wear the configuration of the part of the cutting structure which is acting on the formation is substantially restored to a configuration similar to its initial configuration.

19. A cutting structure for a rotary drill bit, including a front layer formed of superhard material and having a front cutting face defining a cutting edge, and a backing structure of less hard material than said front layer, and at least a portion of the backing structure rearwardly of the cutting edge of the front layer being formed of a number of individual elements having means holding them in position such that, upon wear of the cutting edge and backing structure in use, the holding means of an element engaging the formation will eventually fail, causing detachment of that element from the backing structure, and thereby reducing the area of the backing structure in contact with the formation, the backing structure comprising a solid body formed with slots to define said individual elements, the slots extending only partly through the body of material and being filled with a non-bonding material selected from mica or a refractory non-wetting material.

20. A cutting structure for a rotary drill bit, including a front layer formed or superhard material and having a front cutting face defining a cutting edge, and a backing structure of less hard material than said front layer, and at least a portion of the backing structure rearwardly of the cutting edge of the front layer being formed of a number of individual elements having means holding them in position such that, upon wear of the cutting edge and backing structure in use, the holding means of an element engaging the formation will eventually fail, causing detachment of that element from the backing structure, and thereby reducing the area of the backing structure in contact with the formation, each individual element of the backing structure being selected from an elongate bar, an elongate rod, or an elongate plate, said elements being elongate in a direction away from the front face of the cutting structure and extending at a non-perpendicular angle to said front cutting face.

* * * * *